US008816176B1

(12) United States Patent
Kunkel

(10) Patent No.: US 8,816,176 B1
(45) Date of Patent: Aug. 26, 2014

(54) BANJO WITH IMPROVED RESONANCE

(76) Inventor: Bruce J. Kunkel, East Stroudsburg, PA (US)

( * ) Notice: Subject to any disclaimer, the term of this patent is extended or adjusted under 35 U.S.C. 154(b) by 221 days.

(21) Appl. No.: 13/373,863

(22) Filed: Dec. 3, 2011

Related U.S. Application Data

(60) Provisional application No. 61/419,710, filed on Dec. 3, 2010.

(51) Int. Cl.
*G10D 1/10* (2006.01)

(52) U.S. Cl.
CPC ..... *G10D 1/10* (2013.01)
USPC ..... 84/269

(58) Field of Classification Search
CPC ..... G10D 1/10
USPC ..... 84/269, 274; D17/20
See application file for complete search history.

(56) References Cited

U.S. PATENT DOCUMENTS

| | | | | |
|---|---|---|---|---|
| 269,178 | A | 12/1882 | Chase | |
| 443,159 | A | 12/1890 | Bradbury | |
| 443,510 | A | 12/1890 | Fairbanks | |
| 477,451 | A | 6/1892 | Quinlin | |
| 504,810 | A | 9/1893 | Luscomb | |
| 715,587 | A | 12/1902 | Kraske | |
| 1,503,197 | A | 7/1924 | McDaniel | |
| 1,636,091 | A | 10/1924 | Grover | |
| 1,704,323 | A | 8/1926 | Horton | |
| 1,714,502 | A | 5/1929 | Franic | |
| 2,048,592 | A | 7/1936 | Blanchette | |
| 3,240,096 | A * | 3/1966 | Sloan | 84/272 |
| 4,226,159 | A | 10/1980 | Lowe | |
| 4,483,234 | A | 11/1984 | Snavely | |
| 4,738,178 | A | 4/1988 | Deering | |
| 5,033,349 | A | 7/1991 | Nechville | |
| 7,465,861 | B2 * | 12/2008 | Passafiume | 84/411 R |
| 7,485,789 | B2 | 2/2009 | Gasull | |
| 2005/0235805 | A1 | 10/2005 | Farris | |
| 2006/0011041 | A1 | 1/2006 | Barrett | |

* cited by examiner

*Primary Examiner* — Jianchun Qin

(57) ABSTRACT

A banjo, made almost entirely of wood, eliminates most metal parts of a traditional banjo. The neck is bolted to the body, improving sustain. The body consists of a drum assembly bolted to a resonant tone chamber. The resonant tone chamber consists of a thin back, thin rim assembly, interior flange ring, thin decorative cover and tone ring. The interior flange ring provides mechanical strength to the resonant tone chamber and anchors the drum assembly. The drum assembly consists of a banjo head and a tension hoop. The banjo head snugly fits over the tone ring, and is tensioned via a plurality of bolts that secure the tension hoop in the drum assembly to the flange ring in the resonant tone chamber. A sound port cut into the rim assembly provides sound to a player. Sound holes cut into the decorative cover project sound from the resonant tone chamber toward an audience.

20 Claims, 3 Drawing Sheets

Banjo with Improved Resonance
Bruce J. Kunkel ~ Inventor

Banjo with Improved Resonance
Bruce J. Kunkel ~ Inventor

BANJO WITH IMPROVED RESONANCE

RELATED APPLICATION

This application claims priority to U.S. Provisional Patent Application Ser. No. 61/419,710, filed on Dec. 3, 2010, entitled "The Kunkel Banjo," which is herein incorporated by reference in its entirety.

BACKGROUND

Banjos are stringed musical instruments essentially consisting of a neck and body, with a plurality of tensioned strings strung across both the neck and body, supported by a bridge and secured at each end. The body essentially consists of a banjo head attached to a resonant tone chamber. The banjo head consists of a drum head stretched over a tone ring. A player strums or plucks the strings, causing the drum head to vibrate, and the vibrations to be amplified in the resonant tone chamber. Traditional banjos are largely made from metallic parts, and as a result, are quite heavy. Moreover, due to their design and construction, they produce a very tinny and metallic sound that may not always be desired.

SUMMARY

A new and improved banjo is described. The banjo is made almost entirely of wood, and eliminates most of the heavy metal parts of a traditional banjo. The banjo neck is bolted to its body, improving sustain. The banjo body consists of a drum assembly that is bolted to a resonant tone chamber. The resonant tone chamber consists of a thin back, a thin rim assembly, a flange ring internal to the rim assembly, a thin decorative cover and a wooden tone ring, and replaces the thick, heavy, wooden rim and resonator, cast bronze tone ring and metal hardware of a traditional banjo. The flange ring provides strength and structural integrity to the resonant tone chamber and is used to anchor the drum assembly to the resonant tone chamber. The drum assembly consists of a banjo head and a tension hoop. The banjo head snugly fits over the tone ring on the resonant tone chamber, and is tensioned via a plurality of bolts that secure the tension hoop in the drum assembly to the flange ring in the resonant tone chamber by means of threaded inserts. A sound port can be cut into the rim assembly to provide sound to the player. A plurality of sound holes can be cut into the decorative cover to project sound from the resonant tone chamber toward an audience.

BRIEF DESCRIPTION OF THE DRAWINGS

Elements having the same numerals in the several figures refer to the same elements.

DETAILED DESCRIPTION

Figure 1:
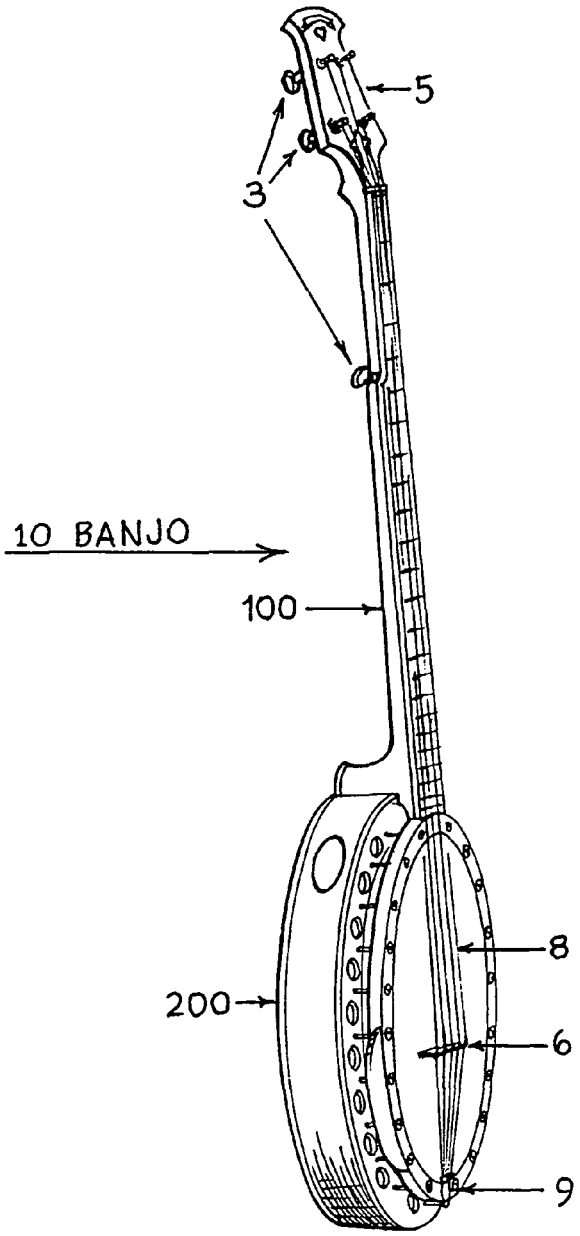
FIG. 1 is an illustration of the banjo 10.

A new and improved form of banjo 10 is shown in FIG. 1. The banjo 10 consists of a peghead 5, a neck 100 and a body

200. A plurality of strings 8 are supported by a bridge 6 and strung across the neck 100 and body 200. The strings 8 are securely attached to a respective plurality of tuning machines 3 in the peghead 5 and side of the neck 100 and to a tail piece 9 attached to the body 200. In one embodiment, the peghead 5 and neck 100 are made from a single piece of material, preferably a hardwood. In some embodiments, a neck angle adjustment system can be added to neck 100 to allow its adjustment as is known in the art. The strings 8 are usually made of steel, and are tensioned via the tuning machines 3 to resonate at a particular fundamental frequency.

As shown in FIG. 1, banjo 10 is traditionally strung with five strings. Other embodiments are possible, however, and banjo 10 can be strung with fewer or more strings. For example, banjo 100 can be strung with four strings to make a banjo ukulele, tenor banjo or a cello banjo, with six or twelve strings to make a guitar banjo, or with eight strings to make a mandolin banjo. Moreover, the strings can be made of a different material, or different combinations of materials such as steel, nickel, bronze or nylon.

Figure 2:
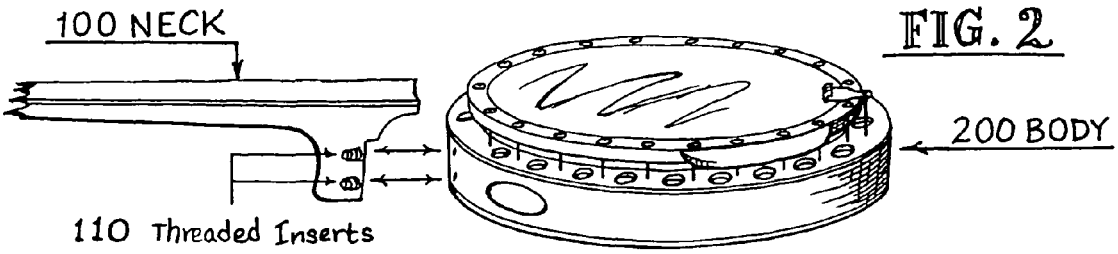
FIG. 2 is an illustration of the neck 100 and body 200 assemblies of banjo 10.
Figure 4:
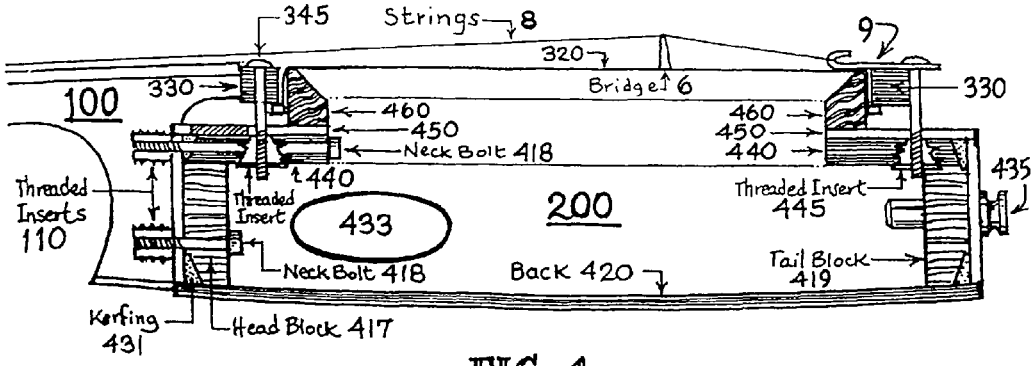
FIG. 4 is a cut-away illustration of a side view of the body assembly 200.

As shown in FIGS. 2 and 4, in one embodiment the neck 100 of banjo 10 is designed to be secured to the body 200 via a plurality of neck bolts 418. The neck bolts 418, which in one embodiment consist of Allen head screws, pass through a head block 417 attached to a rim assembly 430, and are engaged by a respective plurality of threaded inserts 110 in the heel of the neck 100. When tightened, the neck bolts 418 secure the neck 100 of banjo 10 to the body 200. This provides banjo 10 with much more sustain than a traditional banjo. The threaded inserts 110 are typically brass and neck bolts 418 are usually made of steel; however, they can be made of other suitable materials such as other hard metals. The threaded inserts 110 can be tapped into cavities made in the heel portion of neck 100, and can be secured to the heel portion via glue, friction, or other suitable means. It is noted that in traditional banjo designs, dowel sticks and/or coordinator rods are required to secure the neck of the banjo to the body. These dowel sticks are both heavy, and interfere with the resonant properties of the banjo. Due to the rigid construction of the body 200 of banjo 10, as further described below, no such additional parts are required in banjo 10. This results in a much lighter and more resonant banjo.

Figure 3:
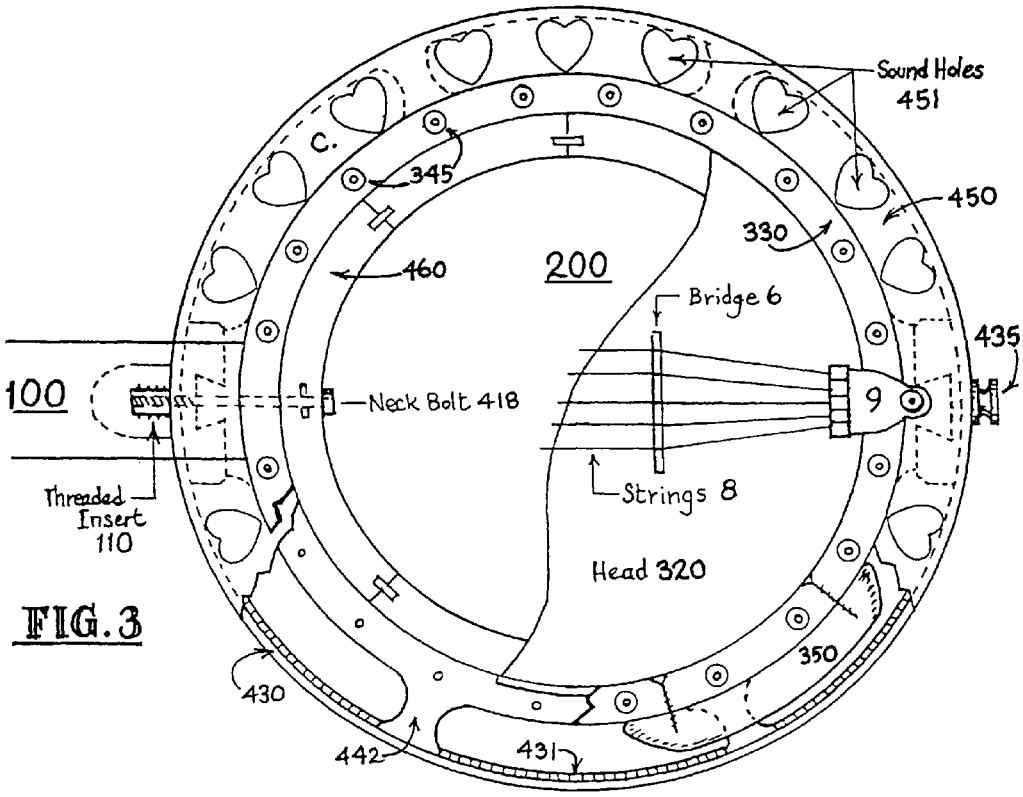
FIG. 3 is a cut-away illustration of the front view of the body assembly 200.
Figure 5:
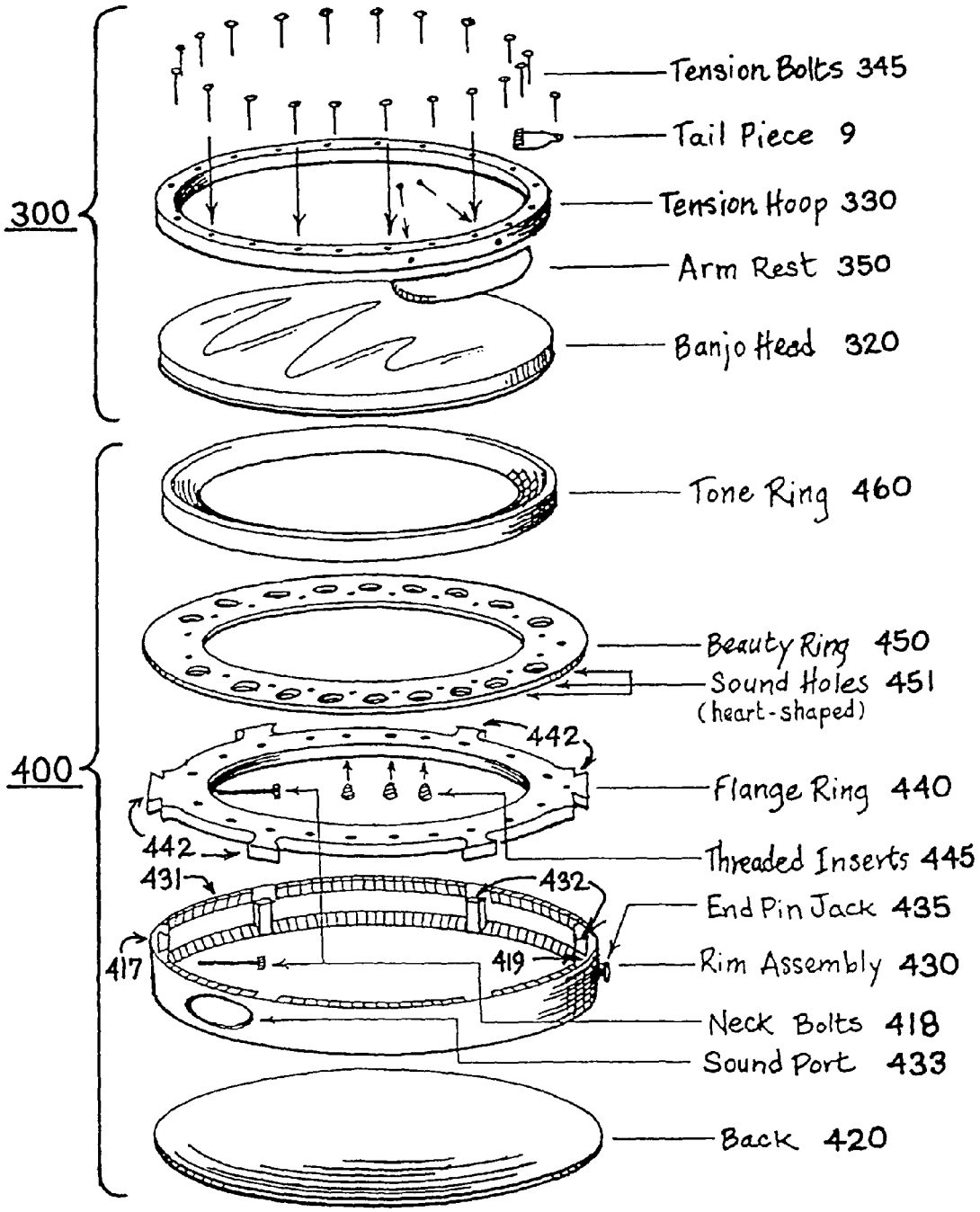
FIG. 5 is an illustration of an exploded view of body assembly 200.

As shown in FIGS. 3, 4 and 5, the body 200 of banjo 10 is comprised of several parts that are rigidly held together, preferably via glue or mechanical fasteners. In particular, as shown in FIG. 5, the body 200 consists of a head assembly 300 that is mechanically attached to a resonant tone chamber 400. The resonant tone chamber 400 consists of a back 420, rim assembly 430, flange ring 440, beauty ring or cover 450, and tone ring 460. In one embodiment, the back 420, rim assembly 430, flange ring 440, beauty ring 450 and tone ring 460 are glued together to form a single, solid resonant tone chamber 400. The head assembly 300 consists of a banjo head 320 and tension hoop 330, and in one embodiment, is secured to the resonant tone chamber 400 via a plurality of tension bolts 345.

The back 420 of resonant tone chamber 400 is a lens shaped piece of wood that is secured to the bottom of the rim assembly 430. In one embodiment, back 420 is made of wood veneers that are laminated together. Alternatively, back 420 can be made out of a solid piece of wood that is carved or turned on a lathe. In one embodiment, a large hole can be cut in the center of back 420 to change the tone of banjo 10 or to allow easy removal of neck 100 without requiring the entire body 200 of banjo 10 to be disassembled.

In one embodiment, rim assembly 430 consists of a strip of wood that is 2" wide, ⅛" thick and formed into a 13¾"

diameter hoop. Kerfing 431 is glued to the inside of rim assembly 430 to give it mechanical support and strength. A head block 417 and a tail block 419 are glued to rim assembly 430, and are separated by 180 degrees as shown. The tail block 419 serves as the anchor for an end pin 435. A strap (not shown) inserted around the end pin 435 can be used to support the weight of banjo 10 while it is played. The end pin can also contain a microphone or electronic pickup and serve to receive a ¼" input jack and cord to amplify the banjo 10. A plurality of mortises 432, are cut into head block 417, tail block 419 and kerfing 431 of rim assembly 430. These mortises 432 are preferably evenly distributed around rim assembly 430, and together with a plurality of corresponding tenons 442 located around the flange ring 440 described below, form a plurality of dovetail joints that secure flange ring 440 to rim assembly 430. In one embodiment, a sound port 433 is cut into the side of rim assembly 430 in an area that is in line with a player's ear. The sound port allows the player to hear banjo 10 more clearly than he would a traditional banjo.

While particular embodiments of rim assembly 430 have been described above, other embodiments are of course possible and within the scope of the invention. For example, the dimensions of rim assembly 430 can be varied to make larger or smaller banjos, kerfing 431 may be unnecessary as the flange ring 440 may be modified to eliminate it. The head block 417 and tail block 419 can be attached to the rim assembly by mechanical means such as wood screws, or can be integrally formed as part of the rim assembly 430, a different number of tenons 432 can be used to secure the flange 440 to the rim assembly 430, and so forth. Other variations are also possible.

The flange ring 440 is the backbone of the resonant tone chamber 400, and gives banjo body 200 its strength despite its light weight. In one embodiment, flange ring 440 is made of 9/16" thick Baltic birch plywood, and includes a plurality of tenons 442 configured to engage a respective plurality of mortises 432 cut into head block 417, tail block 419, and kerfing 431 of rim assembly 430 as previously described. As shown in FIG. 5, in one embodiment six equally spaced tenons 442 are cut into flange ring 440, and are glued into six correspondingly spaced mortises 432 cut into rim assembly 430 to form a plurality of dovetail joints that secure flange ring 440 to rim assembly 430.

A plurality of holes, drilled into flange ring 440, allow flange ring 440 to accept a respective plurality of threaded inserts 445. As discussed below, the threaded inserts 445 receive a plurality of tension bolts 345 that are used to tension the banjo head 320 and to secure head assembly 300 to resonant tone chamber 400. In one embodiment, twenty equally spaced holes are drilled in flange ring 440 for this purpose. Of course, other embodiments are possible, and flange ring 440 can be made of different materials, have different dimensions, and be configured to receive a different number of threaded inserts 445 and/or tension bolts 345. Moreover, a different number of tenons 442 can be formed in flange ring 440 in order to secure flange ring 440 to rim assembly 430.

In one embodiment, a decorative cover or beauty ring 450 is secured to the top of rim assembly 430 and flange ring 440. The beauty ring 450 is made of thin veneered plywood, and can be glued to the rim assembly 430 and flange ring 440. The beauty ring 450 can optionally include a plurality of sound holes 451 for projecting the sound produced in the resonant tone chamber 400, and a plurality of through-holes to allow passage of the tension bolts 345 that secure drum head assembly 300 to the resonant tone chamber 400. The beauty ring can be made of a variety of materials including solid wood, marquetry, veneer; this is only limited by the imagination of the craftsman.

A tone ring 460 is likewise secured to the beauty ring 450. In one embodiment, the tone ring 460 is made from eight pieces of hardwood that are splined together and turned on a lathe. For example, the tone ring 460 can be made from eight pieces of Cocobolo hardwood that are splined into an octagonal shape, which is subsequently turned on a lathe to form a 10" diameter ring having a 1" tall cross-section. Of course, other embodiments of tone ring 460 are possible. For example, tone ring 460 can be made from a solid piece of wood, or from a different number of pieces of wood, or from a different type of wood or other suitable material, and can have different dimensions.

As discussed above, the head assembly 300 of banjo 10 consists of the banjo head 320 and tension hoop 330. The banjo head 320 can be any commercially available banjo head, and is fitted over the tone ring 460. A tension hoop 330 is snugly fitted over banjo head 320 and engages banjo head 320 along its periphery. In one embodiment, the tension hoop is made of ⅝" thick plywood, 11¼" diameter with a ⅝" wide cross section. It fits a 10" diameter commercially made banjo head 320. The tension hoop 330 can be veneered and inlaid to give it an aesthetically pleasing appearance. In one embodiment, a plurality of holes are drilled in the tension hoop 330, and a plurality of threaded tension bolts 345 pass through the holes in the tension hoop 330 and beauty ring 450, and are received by a corresponding plurality of threaded inserts 445 in the flange ring 440. The tension bolts 335 are used to both tension the banjo head 320, and to secure head assembly 300 to the resonant tone chamber 400. In one embodiment, the tension bolts 345 are 2" stainless steel button head Allen screws, and a total of twenty tension bolts 345 are equally spaced about the tension hoop 330 to secure the tension hoop 330 to the flange ring 440 via twenty correspondingly spaced threaded inserts 445 in flange ring 440.

In one embodiment, a hardwood armrest 350 is secured to the tension hoop 330 by means of screws. The armrest 350 is shaped to conform to the outside radius of tension hoop 330, and is optionally added for the player's comfort.

Several features of banjo 10 result from its unique design. First, since many of the parts are made of wood instead of metal, banjo 10 is much lighter than a traditional banjo, and the tone produced by banjo 10 is richer and warmer than the metallic tone produced by a traditional banjo. Since the neck 100 is bolted onto the body 200 of banjo 10, it provides much more sustain than a traditional banjo. The component parts of resonant tone chamber 400, which are glued together to form a single resonant body that includes the thin rim assembly 430, replace the typically thick and heavy wooden rim of a traditional banjo. This greatly increases the interior volume of resonant tone chamber 400, allowing banjo 10 to produce softer, warmer, richer and more resonant tones than a traditional banjo. Moreover, at one-third the weight, banjo 10 produces a comparable volume of sound to that of a traditional bluegrass style banjo. The deep nature of rim assembly 430 also allows a sound port 433 to be cut into the rim assembly 430, allowing sound to be directed upward from the resonant tone chamber 400 to the ear of a player of banjo 10. A plurality of sound holes 451 can be cut into the cover or beauty ring 450 of the resonant tone chamber 400 to allow the sound of banjo 10 to be more efficiently projected toward the audience. Banjo 10 is identical in size to a traditional banjo, and will fit in any standard size banjo case. At 4½ pounds, banjo 10 is easy to carry, and can thus serve as a convenient travel banjo.

The preceding descriptions of specific embodiments of banjo 10 are presented for purposes of illustration and description. They are not intended to be exhaustive or to limit the invention to the precise forms disclosed. Rather, many modifications and variations are possible in view of the above teachings to those of skill in the art. For example, the depth of the rim assembly 430 can be changed to "tune" the resonant tone chamber 400. This can be done to prevent the resonant tone chamber 400 from responding at a dominant frequency or to change the overall tonal characteristics of banjo 10. The resonant tone chamber tone 400, including the rim assembly 430, flange ring 440, beauty ring 450, and tone ring 460 can be made in any shape, and is not limited to the round shape of a traditional banjo. Similarly, the drum assembly 300, including the banjo head 320 and the tension hoop 330 can be made in any shape, and in particular in a shape that matches the resonant tone chamber 400 or certain components within the resonant tone chamber (e.g., the tone ring 460). Thus, the body 200 of banjo 10 can be made into the shape of a guitar, mandolin, bass, or other familiar hollow bodied musical instruments. Moreover, while the body 200 and in particular the resonant tone chamber 400 is described as being made of wood, it can be made out of a variety of other materials. For example, it can be made out of plastic, fiberglass, carbon fiber, ceramic, and similar such materials, which can be fabricated and/or molded to form a monolithic tone chamber to which the neck can be bolted.

The embodiments described were chosen in order to best explain the principles of the invention and its practical applications, and to enable others skilled in the art to best utilize the invention and various embodiments with various modifications as suited to the particular use contemplated. These and other embodiments are deemed to be within the scope of the invention as set forth in the following claims.

What is claimed is:

1. A banjo, comprising:

a neck; and a body, attached to the neck, wherein the body includes a drum head assembly and a resonant tone chamber, and wherein the drum head assembly includes a tension hoop and a banjo head and the resonant tone chamber includes a rim, a head block attached to the rim having a mortise cut therein, and a flange having a tenon to fit the mortise cut into the head block to form a dovetail joint and to provide mechanical strength to the rim.

2. The banjo of claim 1, wherein the head block includes a plurality of through holes through which a plurality of bolts pass to secure the neck to the body.

3. The banjo of claim 1, wherein the resonant tone chamber further comprises a decorative cover secured to the top of the flange, the decorative cover and flange having principal planar surfaces that are substantially parallel and substantially overlapping.

4. The banjo of claim 3, wherein the decorative cover includes a plurality of sound holes cut into its principal planar surface to directly project sound toward the front of the banjo.

5. The banjo of claim 3, further comprising a tone ring, wherein the banjo head covers the tone ring, and the tension hoop is adjacent a periphery of the banjo head and is mechanically attached to the flange.

6. The banjo of claim 5, wherein the flange includes a plurality of threaded inserts to receive a plurality of tension bolts to mechanically attach the tension hoop in the drum head assembly to the flange in the resonant tone chamber, wherein each of the plurality of tension bolts can be adjustably turned to alter the tension of the banjo head.

7. The banjo of claim 1, wherein the rim of the resonant tone chamber further comprises a single sound port to project sound from the resonant tone chamber to a player of the banjo.

8. The banjo of claim 1, wherein the rim of the resonant tone chamber has a substantially uniform thickness, further comprising kerfing glued to the rim of the resonant tone chamber to give mechanical support and strength to the rim, the kerfing having a plurality of mortises cut therein to receive a respective plurality of tenons cut into the flange.

9. A banjo, comprising:

a rim assembly and a back, the rim assembly including a rim, kerfing, and a head block, the kerfing and head block having mortises cut therein;

a flange having a plurality of tenons to fit the mortises cut into the kerfing and head block to form dovetail joints and to rigidly secure the flange to the interior of the rim;

a decorative cover secured to the top of the flange, the decorative cover and flange having principal planar surfaces that are substantially parallel and overlapping;

a tone ring;

a banjo head, floating atop and covering the tone ring;

a tension hoop, adjacent a periphery of the banjo head and securely fastened to the flange via a plurality of adjustable tension bolts, the tension hoop mechanically holding the banjo head over the tone ring and providing tension to the banjo head, the adjustable tension bolts serving to both secure the banjo head to the rim and tune the banjo.

10. The banjo of claim 9, further comprising a neck bolted to the head block via a plurality of neck bolts.

11. The banjo of claim 9, where the rim includes a single sound port to project sound from the resonant tone chamber to a player of the banjo.

12. The banjo of claim 9, wherein the decorative cover includes a plurality of sound holes cut into its principal planar surface to directly project sound toward the front of the banjo.

13. The banjo of claim 9, wherein each of the plurality of tension bolts can be adjustably turned to adjust the tension in the banjo head.

14. The banjo of claim 9, wherein the flange has a plurality of threaded inserts installed to receive the tension bolts.

15. The banjo of claim 9, wherein the kerfing provides mechanical support and strength to the rim.

16. The banjo of claim 9, wherein the rim assembly, flange, decorative cover, tone ring and back are glued together to comprise a single rigid body.

17. A banjo, comprising:

a rim of substantially uniform thickness;

a flange;

means for providing mechanical support to the rim, including a head block attached to the rim;

means for securing the flange to the rim, including a mortice cut into the head block to fit a tenon cut into the flange;

a tone ring;

a banjo head, floating atop and covering the tone ring;

a tension hoop, adjacent to and covering a periphery of the banjo head; and singular means for performing the dual functions of securing the tension hoop to the flange and providing tension to the banjo head.

18. The banjo of claim 17, wherein the means for providing mechanical support to the rim further comprises kerfing attached to the rim; and the means for securing the flange to the rim further comprises a plurality of mortises cut into the kerfing to fit a plurality of tenons cut into the flange.

19. The banjo of claim 17, further comprising a decorative cover secured to the top of the flange, the decorative cover having a principal planar surface that is substantially parallel to and substantially overlaps a principal planar surface of the flange.

20. The banjo of claim 17, wherein the singular means for performing the dual functions of securing the tension hoop to the flange and providing tension to the banjo head include a plurality of adjustable tension bolts and a respective plurality of threaded inserts in the flange.

* * * * *